US005518072A

United States Patent [19]

McTernaghan

[11] Patent Number: 5,518,072

[45] Date of Patent: May 21, 1996

[54] DOWNHOLE TOOL FOR ASSISTING IN SEPARATING AND RECONNECTING WELL TUBING

[75] Inventor: Kenneth McTernaghan, Newtownabbey, Northern Ireland

[73] Assignee: Camco International Inc., Houston, Tex.

[21] Appl. No.: 379,894

[22] Filed: Jan. 30, 1995

[51] Int. Cl.[6] ..... E21B 23/00; E21B 33/10

[52] U.S. Cl. ..... 166/115; 166/242.7

[58] Field of Search ..... 166/242, 115, 166/117; 285/31, 33

[56] References Cited

U.S. PATENT DOCUMENTS

| | | | |
|---|---|---|---|
| 3,378,077 | 4/1968 | Elliston | 166/115 X |
| 4,363,358 | 12/1982 | Ellis | 166/242 X |
| 4,374,543 | 2/1983 | Richardson | 166/242 X |
| 4,657,077 | 4/1987 | Smith, Jr. et al. | 166/115 |
| 5,033,551 | 7/1991 | Grantom | 166/242 X |

*Primary Examiner*—Hoang C. Dang

[57] ABSTRACT

A downhole tool comprising a stinger body including a tubular extension adapted to be inserted into a first end portion of a well tubing, a seal carried on the tubular extension for sealably engaging an interior surface of the first end portion of the well tubing; and a sleeve carried by the stinger body and shiftable from a retracted position when the tubular extension is inserted into the first end portion of the well tubing, to an extended position covering the seal when the tubular extension is removed from the first end portion of the well tubing. The sleeve is held in position covering and protecting the seal by either a set of spring loaded lugs or a set of shear pins.

4 Claims, 2 Drawing Sheets

DOWNHOLE TOOL FOR ASSISTING IN SEPARATING AND RECONNECTING WELL TUBING

BACKGROUND OF THE INVENTION

1. Field of the Invention

The present invention relates to a downhole tool for assisting in separating and reconnecting well tubing and, more particularly, to a polished bore and anchor seal assembly that has a mechanism to prevent seal damage.

2. Description of Related Art

A wellbore production tubing string has several different types of devices that are attached thereto and which are necessary to the operation of the well. For example: an expansion joint can be used to accommodate length changes in the tubing due to thermal or pressure fluctuations; or a device to establish communication between the tubing string and the wellbore annulus, commonly referred to as a sliding sleeve or sliding side door may be used; and by statute, all offshore wells are required to have an operational subsurface safety valve. Additionally, if the well bore requires artificial lift, a gas lift mandrel or an electric submersible pump can be used. Any or all of the above described devices may be required to be removed for periodic maintenance or repair. To effect repair of these devices, removal of the production tubing string is necessary.

The task of removing the production tubing is complicated by its attachment to packers and the inherent difficulty in disengaging or releasing the packer. To overcome this problem, devices have been designed to allow for the separation of tubing so that some items may be easily left in the well bore while others items are removed. Several of such separation type devices are described in the 1986 "Packers And Completion Accessories Catalog" published by Camco Products & Services Company, a division of Camco International, Inc. One such device is described on Page 26 of that catalog, and is referred to as a "stinger", but is also commonly referred to as an "anchor seal assembly", and contains several latching configurations, a set of chevron packing seals and a metallic body mandrel to resist applied pressure and tensile loads. This device stabs into, latches and seals at the top of a wellbore packer. A second device of this type is shown on Page 62 of the same catalog, and is called a Type A Safety joint. This device has a coarsely pitched left handed thread, and O-ring seals so that the tubing can be separated by torque applied in the right hand or clockwise direction. Other similar devices are further described in that catalog.

An inherent problem in each of these devices is in reestablishing the connection and effecting a fluidic seal once disengaged without damaging the annular packing seals. This problem is exacerbated in deviated or horizontal sections of wells for the following reasons. In the case of safety joints or any such device that relies on an elastomeric O-ring to effect a seal between the upper and lower halves, separation and reconnection is not considered possible since the likelihood of damage to an essential O-ring is high in either or both operations. The stingers and related separation and relatching tools have redundant chevron seals on the upper male half of the connector but are subjected to abrasion wear against the casing when the exposed seals are dragged or pushed through horizontal or deviated well sections.

There is a need for a device to allow for the release and reconnection of the tubing from a device fixed in a well, while protecting the annular seals during removal and/or reconnection.

SUMMARY OF THE INVENTION

The present invention has been conceived to overcome the foregoing deficiencies and meet the above described needs. Specifically, the present invention can intermittently separate and reconnect a length of well tubing while providing protection to the annular packing seals by employing a movable protector sleeve. A seal protector sleeve of the present invention is deployed when a stinger is removed from a polished bore receptacle, and the seal protector sleeve retracts when re-inserted. When operational necessity dictates that the tubing must be separated, the seal protector sleeve slides over the easily damaged seals and is temporarily locked in place as the stinger is separated from the polished bore receptacle. This seal protector sleeve thereby protects the seals from abrasion damage in transit. When reconnection of the tubing is desired, the protector sleeve is deposited and re-locked in position in the polished bore receptacle of the tool as the stinger is reinserted. Once so positioned, the stinger and polished bore receptacle can be re-latched, and the fluidic seal can be re-established all without damaging the annular seals.

DETAILED DESCRIPTION OF THE PREFERRED EMBODIMENTS

The present invention discussed briefly above is a downhole tool which can intermittently separate and reconnect a length of well tubing while providing protection to annular packing seals. A seal protector sleeve is deployed when a stinger is removed from a polished bore receptacle, and the seal protector sleeve retracts when re-inserted. When operational necessity dictates that the tubing string must be separated, the seal protector sleeve slides over the annular packing seals, and is temporarily locked in place as the stinger is separated from the polished bore receptacle to protect the seals from abrasion damage in transit. When reconnection of the tubing string is desired, the protector sleeve retracts and is deposited and re-locked in position in the polished bore receptacle as the stinger is reinserted. Once so positioned, the stinger and polished bore receptacle can be re-latched, and a fluidic seal re-established without damaging the annular seals.

Figure 1:
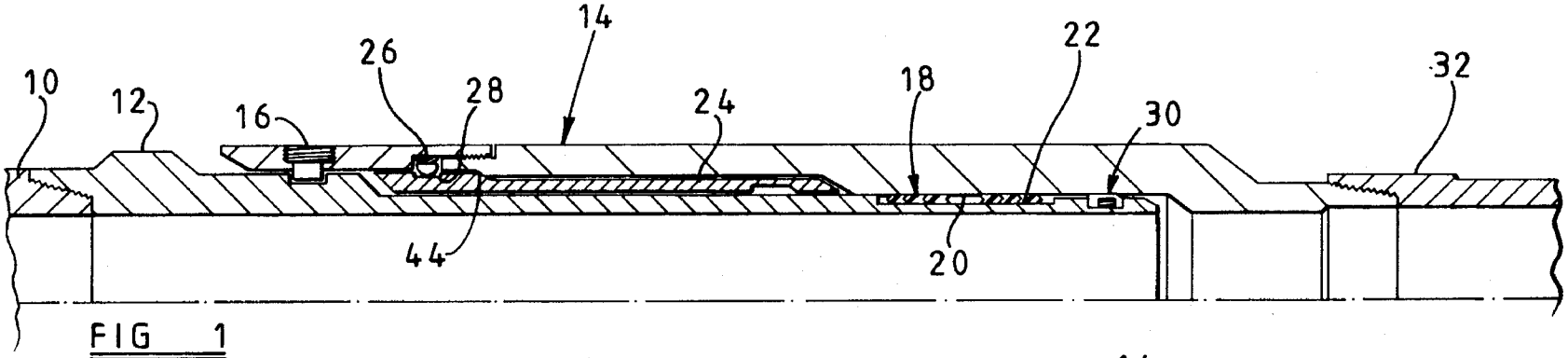
FIG. 1 is side elevational view in cross section of one preferred embodiment of a downhole tool of the present invention and is shown in its assembled position.

Referring now to FIG. 1, a first length of well tubing 10 is shown sealably connected to a stinger body 12, as is well known to those skilled in the art. The stinger body 12 is releasably connected to a polished bore receptacle 14 by a shear pin 16. A bore seal 18 assures a fluidic seal between a polished bore 20 and an outside diameter seal surface 22 on the stinger body 12. The bore seal 18 is annular and can be formed from elastomeric material, plastic material or metallic material. The largest outside diameter on the stinger body 12 is generally larger than the first length of well tubing 10 in order to centralize the stinger body 12 in the well casing (not shown) to facilitate reinsertion of the stinger body 12 into the polished bore receptacle 14. An internal seal protector sleeve 24 is shown held in position in the polished bore receptacle 14 by a spring biased detent lug 26 which engages a detent groove 28 in the internal seal protector sleeve 24. The seal protector sleeve 24 is prevented from longitudinal movement by the detent lug 26, and is prevented from further longitudinal movement by an inside no-go shoulder 44 on the inside of the polished bore receptacle 14. A selective spring loaded dog 30 is shown in position on the stinger body 12, and is in spring biased contact with the polished bore receptacle 14 in its polished bore 20. In turn, the polished bore receptacle 14 is sealably connected to a second length of well tubing 32. When connected in this position, fluidic communication between the inside and outside of the well tubing 10 is prevented since any potential fluidic leak path, as a result of the connection of the stinger body 12, and the polished bore receptacle 14 is blocked by the bore seal 18. The configuration shown in FIG. 1 is when the downhole tool of the present invention is inserted into the wellbore and when fluids are being produced to the earth's surface through the tubing sting 10 and 32.

Figure 2:
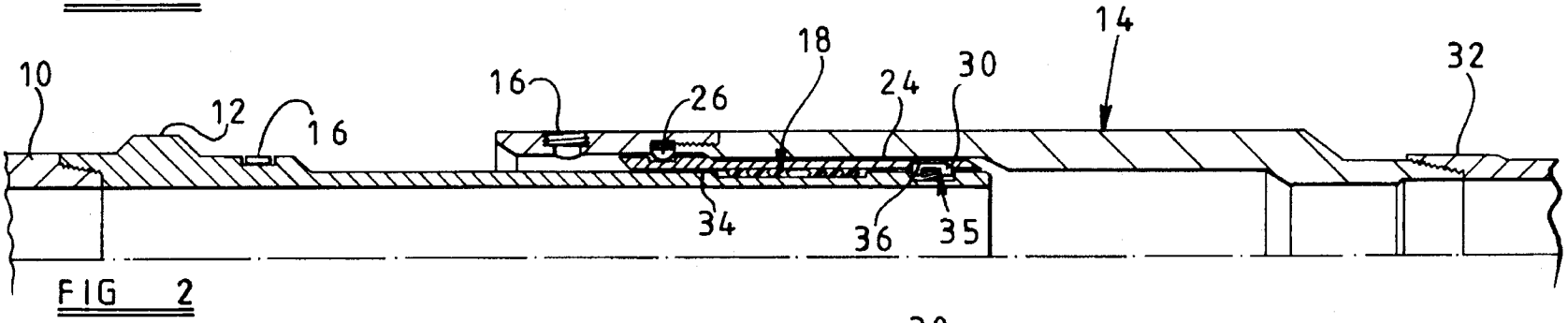
FIG. 2 is a side elevational view in cross section of the downhole tool of FIG. 1 with a stinger partially withdrawn to allow an internal seal protector sleeve to slide over and protect a chevron seal assembly on the stinger.
Figure 2A:
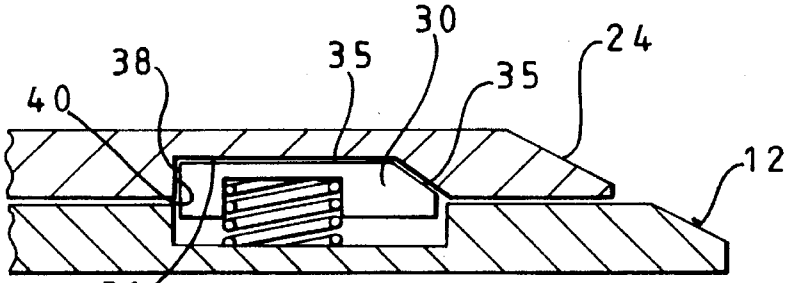
FIG. 2A is partial elevational view in cross section of the downhole tool of FIG. 1 which details a mechanism to temporarily lock the seal protector sleeve in engagement over the stinger.

When downhole equipment is to be removed from the wellbore, the tubing string 10 and 32 is to be separated. FIG. 2 illustrates partial retraction of the well tubing 10 and the stinger body 12 from the polished bore receptacle 14. Axial force placed on the first length of well tubing 10 causes the shear pin 16 to shear releasing the stinger body 12, allowing it to move relative to the stationary polished bore receptacle 14. The internal seal protector sleeve 24 remains in stationary position in the polished bore receptacle 14 as it is held by the spring biased detent lug 26. The bore seal 18 moves into contact with an inside diameter 34 of the seal protector sleeve 24. As shown in FIG. 2A, the spring loaded dog 30 has on its outside surface an external selective profile 35 which finds and engages a matching internal selective profile 36 in the seal protector sleeve 24. Movement of the spring loaded dog 30 into a position adjacent to the internal selective profile 36 causes the spring loaded dog 30 to move radially outward to temporarily lock the stinger body 12 to the seal protector sleeve 24. During this operation, the polished bore receptacle 14 remains stationary and fixed to the second length of well tubing 32.

Figure 3:
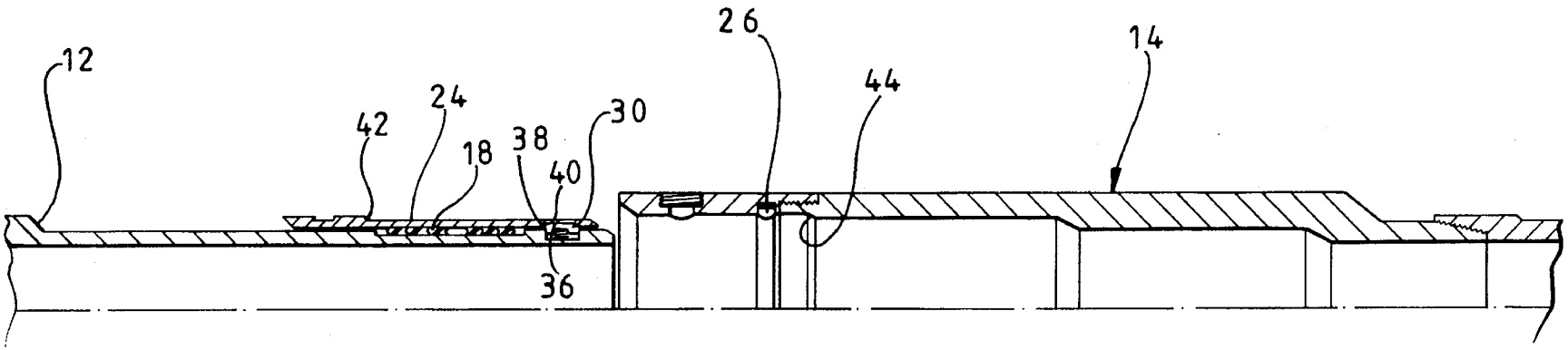
FIG. 3 is side elevational view in cross section of the downhole tool of FIG. 1 with the stinger and the internal seal protector sleeve withdrawn from a polished bore receptacle.

Full retraction of the stinger body 12 from the polished bore receptacle 14 is illustrated in FIG. 3. A square shoulder 38 on a spring loaded detent lug 30 bearing against a matching shoulder 40 in the selective profile 36 is sufficient to overcome any retaining force exerted by the spring loaded detent lug 30 on the stinger body 12. When the first length of well tubing 10 and stinger body 12 are disengaged from the polished bore receptacle 14, the seal protector sleeve 24 moves as a result of the spring loaded detent lug 30 engaging the selective profile 36, and is temporarily locked in a position covering the bore seal 18 thereby protecting it from abrasion or impact damage as the stinger body 12 is either fully or partially withdrawn from the well.

To reconnect the well tubing 10 and 32, the stinger body 12 is moved axially until an outside no-go shoulder 42 on the seal protector sleeve 24 contacts an inside no-go shoulder 44 on the polished bore receptacle 14, thereby preventing the seal protector sleeve 24 from further longitudinal movement. Additional longitudinal movement by the stinger body 12 causes an inward movement of the spring loaded dog 30, thereby releasing the seal protector sleeve 24 from the stinger body 12. This releasing or unlocking action allows the stinger body 12 to return to its original position in the polished bore receptacle 14, as shown in FIG. 1, while the seal protector sleeve 24 is once again locked in position between the inside no-go shoulder 44 and the detent groove 28.

The preferred embodiment detailed in FIGS. 1, 2 and 3 are shown concentric to the centerline of the well tubing 10 and 32 and with the stinger body 12 as the removable portion and the polished bore receptacle 14 as the stationary portion. Other preferred embodiments of the present invention include the use of this device in eccentric applications, such as side pocket mandrels, and dual packers as are well known to those skilled in the art. Additional preferred embodiments of the present invention can be employed in packers, expansion joints, safety joints, or in any other downhole location where separation of the tubing is advantageous. Additional embodiments can include reversing the action of the invention, whereby the polished bore receptacle 14 acts as the removable portion of the tool and the stinger body 12 is stationary.

Whereas the present invention has been described in particular relation to the drawings attached hereto, it should be understood that other and further modifications, apart from those shown or suggested herein, may be made within the scope and spirit of the present invention.

What is claimed is:

1. A downhole tool comprising:

a stinger body including a tubular extension adapted to be inserted into a first end portion of a well tubing;

a sealing means carried on the tubular extension for sealably engaging an interior surface of the first end portion of the well tubing; and a sleeve carried by the stinger body and shiftable from a retracted position when the tubular extension is inserted into the first end portion of the well tubing, to an extended position covering the sealing means when the tubular extension is removed from the first end portion of the well tubing, wherein the sleeve is deployed and locked over the sealing means by the use of at least one spring loaded lug in the stinger body contacting an interior surface recess in the sleeve.

2. The downhole tool of claim 1 wherein the stinger body is threadably connected to the first end portion of the well tubing.

3. The downhole tool comprising:

a stinger body including a tubular extension adapted to be inserted into a first end portion of a well tubing;

a sealing means carried on the tubular extension for sealably engaging an interior surface of the first end portion of a well tubing; and a sleeve carried by the stinger body and shiftable from a retracted position when the tubular extension is inserted into the first end portion of the well tubing, to an extended position covering the sealing means when the tubular extension is removed from the first end portion of the well tubing, wherein the stinger body includes shear pins for removable connection of the stinger body to the first end portion of the well tubing.

4. The downhole tool of claim 3 wherein the stinger body is threadably connected to the first end portion of the well tubing.

* * * * *